United States Patent [19]

Churchman

[11] 4,375,237

[45] Mar. 1, 1983

[54] WELL EQUIPMENT SETTING OR RETRIEVAL TOOL

[75] Inventor: Ronald K. Churchman, Plano, Tex.

[73] Assignee: Otis Engineering Corporation, Dallas, Tex.

[21] Appl. No.: 879,968

[22] Filed: Feb. 21, 1978

[51] Int. Cl.[3] ..... E21B 23/03

[52] U.S. Cl. ..... 166/117.5; 166/381

[58] Field of Search ..... 166/315, 117.5; 175/256; 285/118

[56] References Cited

U.S. PATENT DOCUMENTS

| | | | |
|---|---|---|---|
| 3,483,934 | 12/1969 | Fuchs | 175/267 |
| 3,799,259 | 3/1974 | Dinning | 166/117.5 |
| 3,899,025 | 8/1975 | Dinning | 166/117.5 |
| 4,002,203 | 1/1977 | Terral | 166/117.5 |
| 4,074,762 | 2/1978 | Parker | 166/117.5 |

FOREIGN PATENT DOCUMENTS 2239581 2/1975 France .

*Primary Examiner*—William F. Pate, III

*Attorney, Agent, or Firm*—Vinson & Elkins

[57] ABSTRACT

Disclosed is a tool for setting or retrieving well equipment. One section of the tool is movable between a running position and an actuated position for setting or retrieving well equipment. Actuation of that one tool section is controlled by another section which engages a single shoulder in the tubing and moves between multiple positions. Prior to actuation, the rotational orientation of the tool in the well is fixed. This abstract of the disclosure is neither intended to define the scope of the invention, which, of course, is measured by the claims nor is it intended to limit the invention in any way.

17 Claims, 16 Drawing Figures

WELL EQUIPMENT SETTING OR RETRIEVAL TOOL

BACKGROUND OF THE INVENTION

1. Field of the Invention

This invention relates to a well tool for setting and/or retrieving well equipment in a well. More particularly the invention relates to a setting and/or retrieval tool having any combination of an operation section for setting and/or retrieving well equipment, an actuating section for actuating the operation section, and an orientation section for rotationally orienting the operation section in a well tubing string.

2. The Prior Art

Numerous tools (such as disclosed in U.S. Pat. Nos. 4,002,203; 3,899,025; 3,876,001; 3,837,398; 3,827,490; and 3,799,259 and United States application Ser. No. 490,557 filed July 24, 1974) will set and/ or retrieve well equipment from the side pocket receptacle of a side pocket mandrel. Generally, such tools include an operation section, and actuation section, and an orientation section. The operation section is normally in a running position. Upon actuation, it assumes a setting and/or retrieving position. The actuation section of the tool controls actuation of the operation section. The orientation section rotationally orients the operation section prior to its actuation.

The operation section of the tool generally includes an arm. Actuation of the tool may latch the arm in its actuated position (see U.S. Pat. Nos. 3,876,001 and 3,837,398 and Application Ser. No. 490,557). Thereafter, even though the arms of the tools disclosed in the aforementioned U.S. Pat. No. 3,837,398 and application Ser. No. 490,557 may be returned to a position aligned with the tool body, the arms of such tools are free to reassume their actuated position. Thus, the arm inhibits movement of the tool in one of two directions through the tubing string. Movement in that one direction is inhibited because the arm's assumption of its actuated position causes it to hang up on obstructions in the well tubing. The tool can only be moved in the other direction for retrieval.

Redressing present kickover tools may be quite complicated. Several shear pins may have to be replaced and components of the tool precisely positioned. Such redressing may require additional equipment and may result in operating delay and expense. Additionally, at the present, shear stock is lost in the well. Lost shear stock may cause complications with the running and operation of additional well tools.

Orientation of setting and/or retrieving tools within a well's tubing string is occasionally difficult. The orientation sections of the tools disclosed in U.S. Pat. Nos. 4,002,203; 3,827,490; 3,876,001; and 3,837,398; and Application Ser. No. 490,557 rely upon a single key to both centralize the orientation section within the tubing string and locate the orientation guide surface. If the single key does not first perform it centralizing function, it may not be able to locate and engage the orientation guide surface. Consequently, the tool may not be properly oriented within the tubing string.

The orientation section of the tool disclosed in U.S. Pat. No. 3,797,259 includes a pair of longitudinal vanes. The vanes centralize the orientation section with the tubing. In addition to performing its centralizing function, one of the vanes includes a cam for engaging the orientation guide surface. The guide surface seeking cam cannot move independently of its vane. U.S. Pat. Nos. 3,899,025 and 3,378,080 disclose well tools, the actuation of which occurs in response to pressurizing well fluids in the vicinity of the tool. Neither of the disclosed tools includes hydraulic means operable in response to relative movement of tool components for generating a tool actuating force.

OBJECTS OF THIS INVENTION

An object of this invention is to provide a tool for setting and/or retrieving well equipment and having an operating arm which is movable between a running position and an operating position, and wherein a portion of the operating arm is fully retractable once the desired operation has been performed so that the tool may thereafter move in two directions through the well's tubing string.

Another object of this invention is to provide a hydraulic actuator for a well tool which actuates an operation tool section upon a select force being applied to the hydraulic actuation tool section.

Another object of this invention is to provide an orientation section for a tool that is inherently centered within the well tubing and has an independent orientation key for locating an orientation guide surface in the well tubing.

These and other objects and features of advantage of this invention will be apparent from the detailed description, the drawings, and the appended claims.

BRIEF DESCRIPTION OF THE DRAWINGS

In the drawings, wherein like numerals indicate like parts, and wherein an illustrative embodiment of this invention is shown.

DETAILED DESCRIPTION OF THE PREFERRED EMBODIMENT

Figure 1:
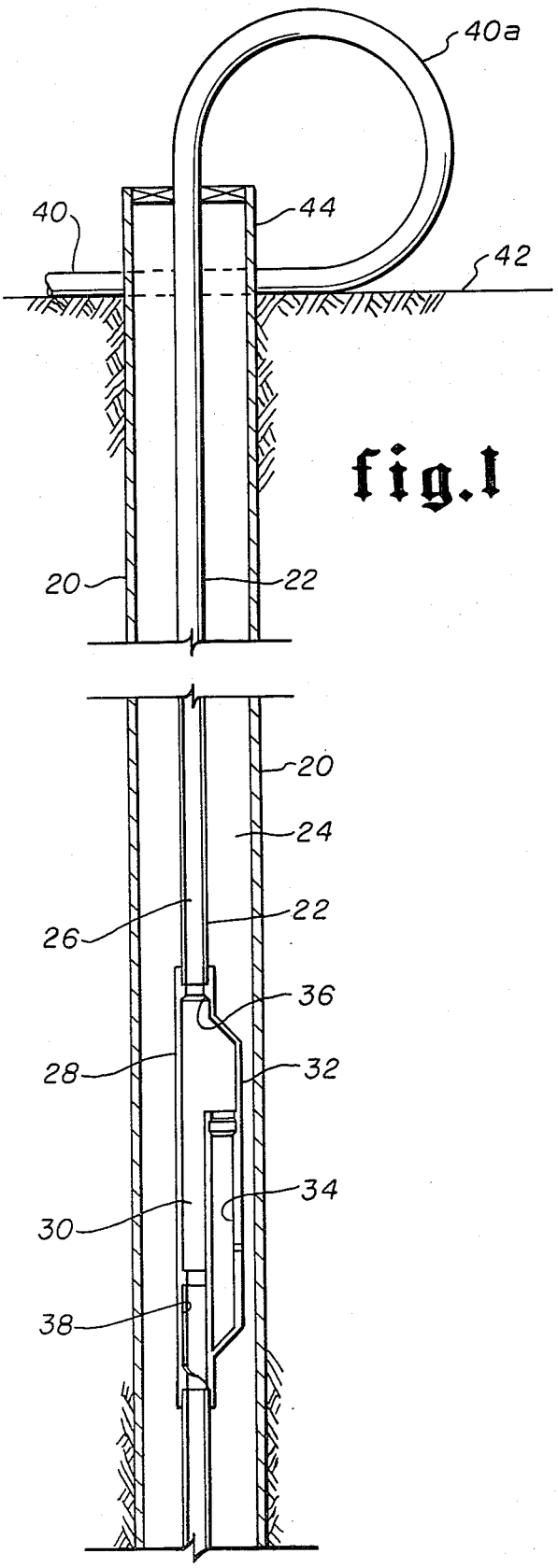
FIG. 1 is a schematic illustration of a well installation in which the well tool of this invention may be utilized.

A well installation in which the well tool of this invention is useable, is illustrated in FIG. 1. The well wall is cased with a casing string 20. Through the casing string 20 extends a production tubing string 22. Fluid communication through the well may be confined to the annulus 24 between the casing string 20 and the tubing string 22 and to the bore 26 of the tubing string 22.

Mandrel 28 forms a portion of the tubing string 22. Fluid communication between the annulus 24 and the bore 26 occurs through mandrel 28. Mandrel 28 is adapted to receive a flow control device to control that tubing to annulus communication. The illustrated mandrel 28 is commonly referred to as a side pocket mandrel. The side pocket mandrel 28 includes a longitudinally extending bore 30 which is aligned with the bore 26 extending through the tubing string 22. The mandrel 28 also includes a side pocket offset 32 having a side pocket receptacle 34 for receiving the flow control device. For cooperating with a work tool during the setting and retrieval of a circulating device from the receptacle 34, the mandrel 28 has an activating shoulder 36 located above the offset 32 and facing downwardly and also has an orientation sleeve 38 located below the articulating-operating region of the work tool and in close proximity to the receptacle 34.

The activating shoulder 36 and orientation sleeve 38 are preferably designed not to interfere with the passage of well tools through the bore 26 of the tubing string 22. Preferable, both the activating shoulder 36 and orientation sleeve 38 are out of the open bore 26 extending through the tubing string 22. The innermost projection of activating shoulder 36 does extend slightly into the projected bore 26 of the tubing string 22 (for example, for 2 inch nominal tubing, the internal diameter of the activating shoulder 36 would be 1.875 inches. Such diameter is sufficient to pass all tools commonly used in wells equipped with 2 inch nominal tubing.) However, the orientation sleeve 38 preferably does not extend radially inwardly into the open bore 26. In other words, the innermost projecting surfaces of the orientation sleeve 38 are preferably aligned with and have the same diameter as the bore 26 of the tubing string 22. Thus, well tools which do not include components adapted to seek and expand into regions out of the open bore can pass through the activating shoulder 36 and the orientation sleeve 38.

Tools are run through the tubing string 22 to set and land a circulating device in the side pocket receptacle 34 and to retrieve a circulating device from the side pocket receptacle 34. The illustrated well installation is equipped for through-the-flow-line pump down service. A flow line 40 extends along the ocean floor 42 from a central service station (not shown) to the well head 44. Upon approaching the well head 44, the flow line forms a loop **40*a* so that tools may enter the downwardly depending tubing string 22**.

Figure 2:
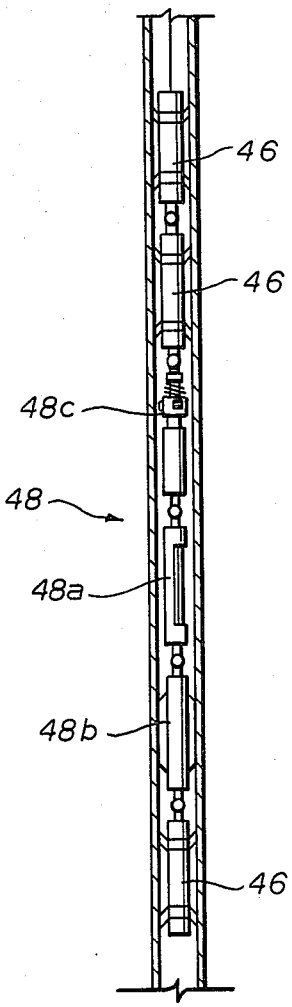
FIG. 2 is a schematic illustration of the well tool of this invention incorporated into a tool train.

Tools must pass through the flow line loop **40*a* prior to entering the tubing string 22. Therefore, sections of a tool train are interconnected with articulating joints and the length of individual tool sections is limited. A tool train is illustrated in FIG. 2. The tool train includes spaced locomotive means 46 and a tool 48. The spaced locomotive means 46 engage the wall of the flow line 40 and the tubing string 22 and are moved therethrough under the action of pumped fluids. The tool 48 will be used to set or retrieve equipment, such as a flow control device, from the mandrel 28. During running of the tool 48, components having a longitudinal dimension greater than the width of the tool 48 are aligned. Protruding parts are retractable. The likelihood of tool hang up on obstructions in the tubing string 22 is thus substantially eliminated. Upon actuation, the tool 48 operates in the mandrel 28 to install or retrieve equipment. An arm is articulated. A longitudinal force is applied to the tool 48 which is transmitted through the articulated arm to the circulating device in a direction substantially aligned with the longitudinal centerline through the receptacle 34. After the setting or retrieval operation, the tool 48 assumes a retrieving position. Again, components having a longitudinal dimension greater than the tool width become aligned. In addition to the foregoing operation, the tool 48 can negotiate the loop portion 40*a* of the flow line 40. It includes interconnected sections with articulating joints therebetween. One such section is operation section 48*a*. The operation section 48*a* performs the desired operation of installing or retrieving equipment from the side pocket receptacle 34. Another section of the tool 48 is orientation section 48*b*. The orientation section 48*b* rotationally orients the tool 48 with respect to the side pocket receptacle 34 when the tool 48 is in the mandrel 28. A third section of the tool 48 is actuation section 48*c*. The actuation section controls the operation section 48*a*** and actuates it from a running position to its activated position for setting and/or retrieving equipment.

The operation of a tool 48 within a mandrel 28 is illustrated in FIGS. 3 through 6.

Figure 3:
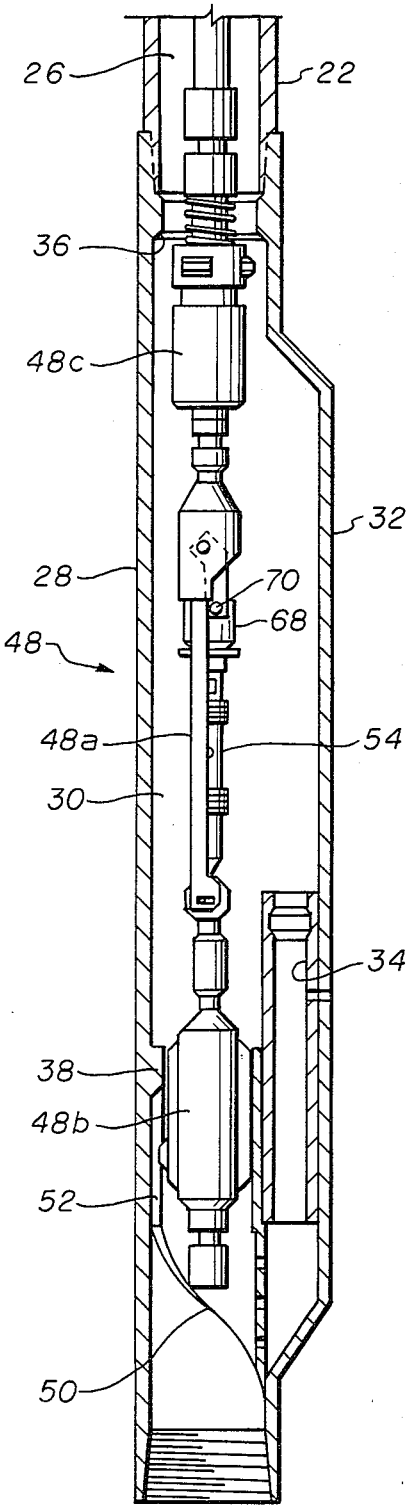
FIG. 3 is a view of the operating mandrel of the well in vertical cross-section and with the tool of this invention in elevation and having its components in their running position.
Figure 4:
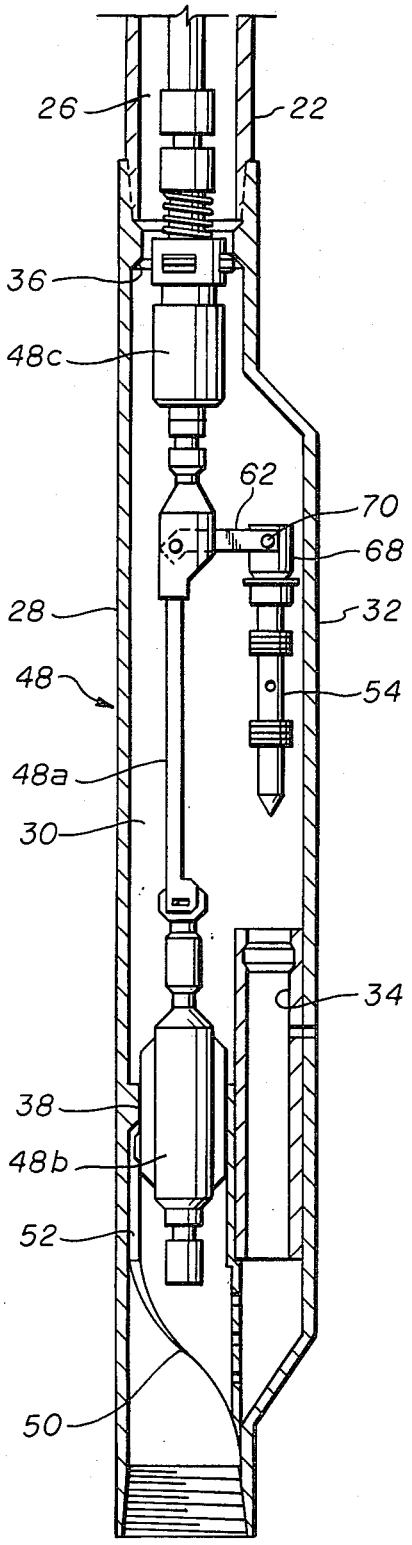
FIG. 4 is a view similar to FIG. 3 showing the tool after actuation.
Figure 5:
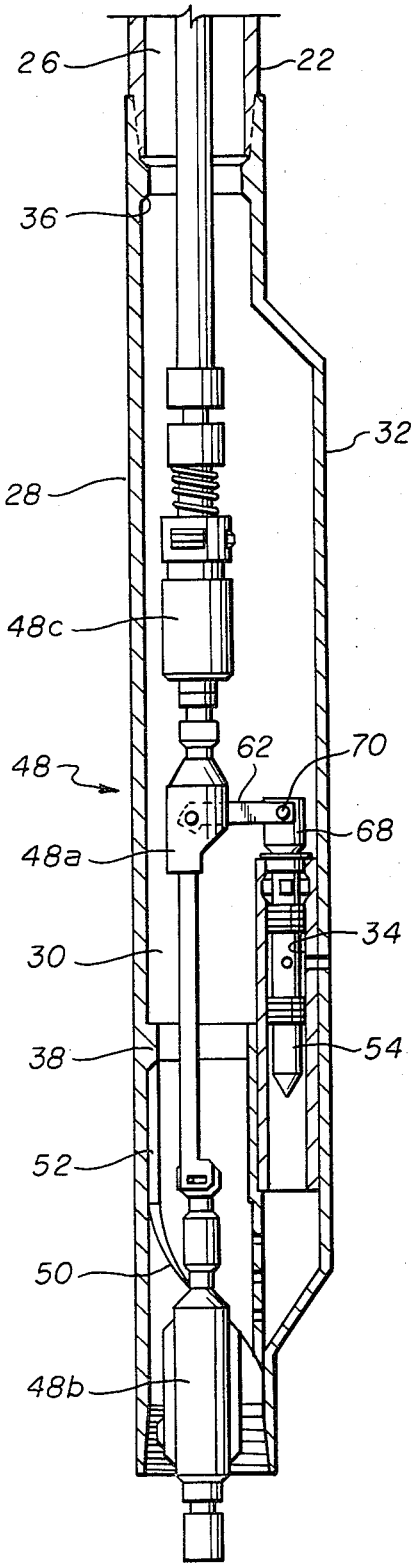
FIG. 5 is a view similar to FIGS. 3 and 4 showing the tool setting equipment in the well.

The tool 48 is run through the tubing string 22 in a first, downward, direction through and past the mandrel 28 in which it is desired to operate. Once the tool 48 is below the mandrel 28, the tool 48 is moved in a second, upward, direction through the tubing string 22. As the tool 48 moves through the mandrel 28, the orientation section **48*b* will cooperate with the orientation sleeve 38. As illustrated in FIGS. 2 through 5, the orientation sleeve 38 has a downwardly facing guide surface 50 which terminates in an upwardly extending guide slot 52. The wall thickness of the orientation sleeve is approximately 0.20 inch. Therefore, the depth of the guide surface 50 and the depth of the guide slot 52 is also approximately 0.20 inch. Locating and engaging that small surface 50 and slot 52 is thus exceedingly difficult. To increase the likelihood of engaging the guide surface, the orientation section 48*b* first centralizes itself in the orientation sleeve 38 and thereafter engages the guide surface 50. Once the guide surface 50 is engaged, the orientation section follows that guide surface 50 and rotationally orients at least the operation section 48*a* of the tool 48 with respect to the side pocket receptacle 34. In FIG. 3, the orientation section 48*b* has engaged the guide slot 50 and has rotationally oriented the operation section 48*a***.

Further movement of the tool in that second, upward direction through the tubing string 22 results in actuation of the operation section **48*a*. The actuation section 48*c* engages the activating shoulder 36. Upon continued force application to the tool body, the actuation section 48*c* actuates the operation section 48*a*. The operation section 48*a*, is actuated from its running position to its setting and/or retrieving position (see FIG. 4**).

Thereafter, the tool 48 is run in a first, downward, direction through the tubing string to set or retrieve equipment, such as the circulating device 54 shown, in the side pocket receptacle 34. Force is applied to the tool body in that first, downward, direction to assure that the circulating device 54 is locked in the receptacle 34 (see FIG. 5).

Figure 6:
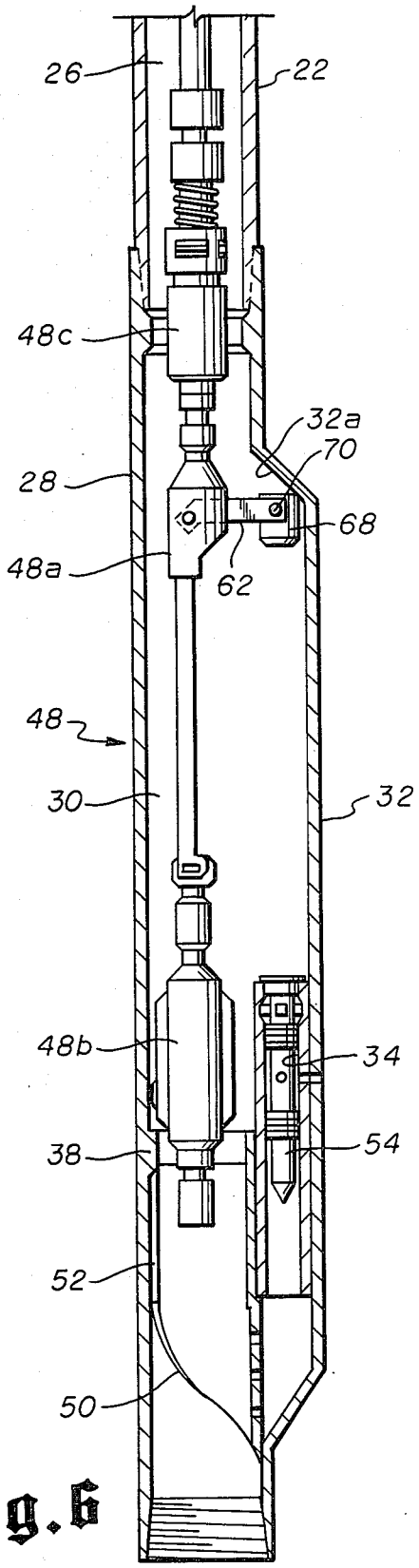
FIG. 6 is a view similar to FIGS. 3, 4 and 5 showing the tool after releasement of the landed equipment.

Once the circulating device 54 has been landed, the tool 48 is retrieved. The tool is moved through the tubing string in a second, upward, direction. The tool 48 releases from the circulating device 54. The actuation section 48*c* passes through the activating shoulder 36 without engaging that shoulder 36. The operation section 48*a* assumes a retrieving position. In FIG. 6, the tool 48 is illustrated after having released from the circulating device 54 and after the actuation section 48*c* has passed through the activating shoulder 36 and prior to the operation section 48*a* assuming its retrieving position.

The detailed structure of a tool constructed in accordance with this invention is illustrated in FIGS. 7A, 7B, and 7C and 8 through 13.

Figure 7A:
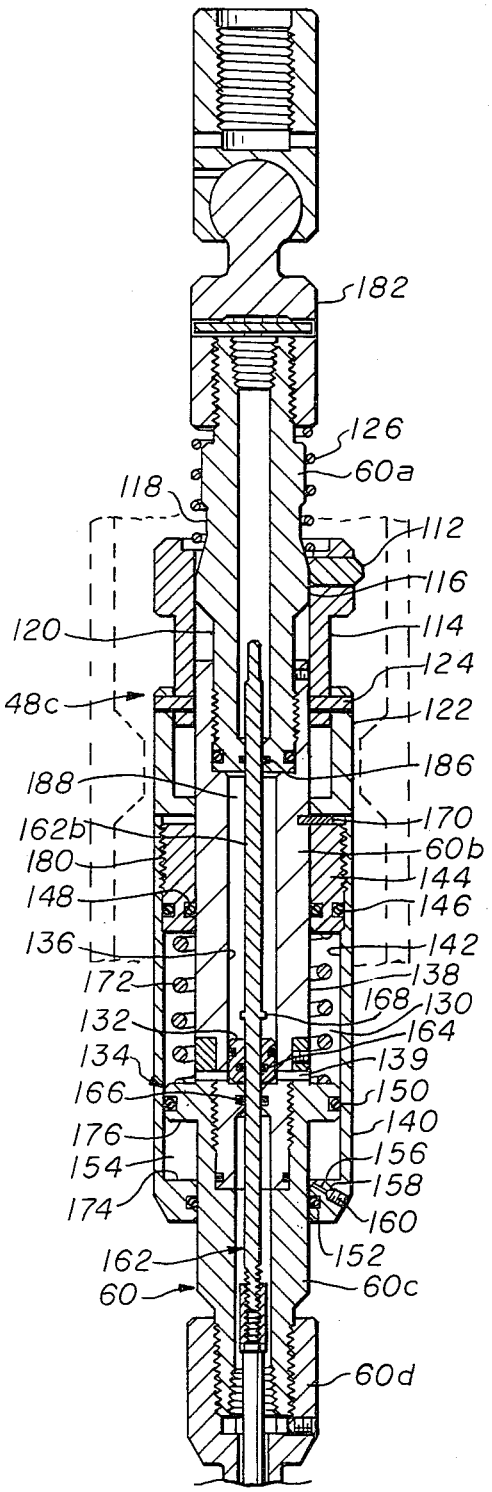
FIGS. 7A, 7B, and 7C are continuation views, partly in elevation and partly in section, showing a well tool constructed in accordance with this invention.
Figure 7B:
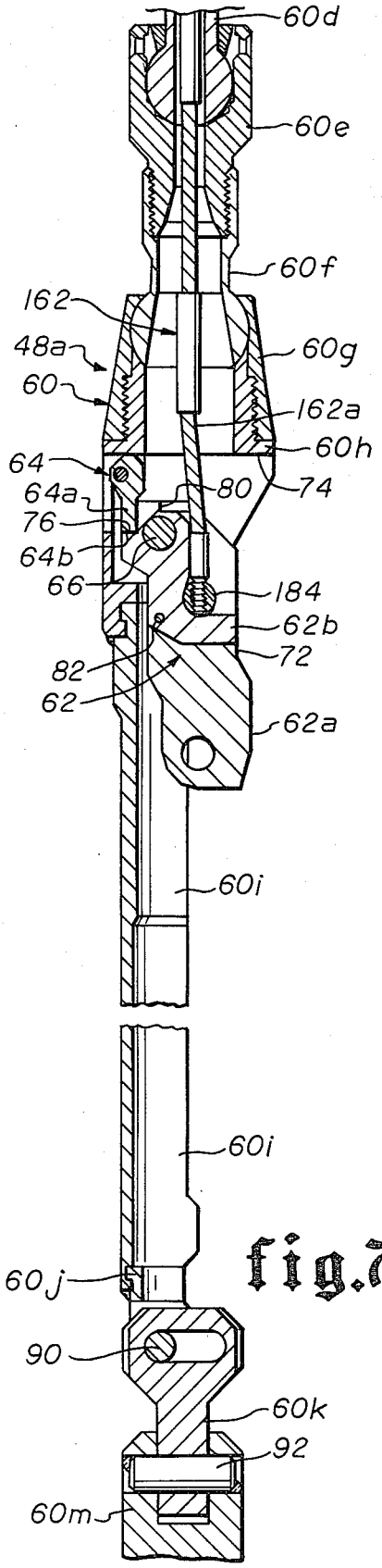
Figure 7C:
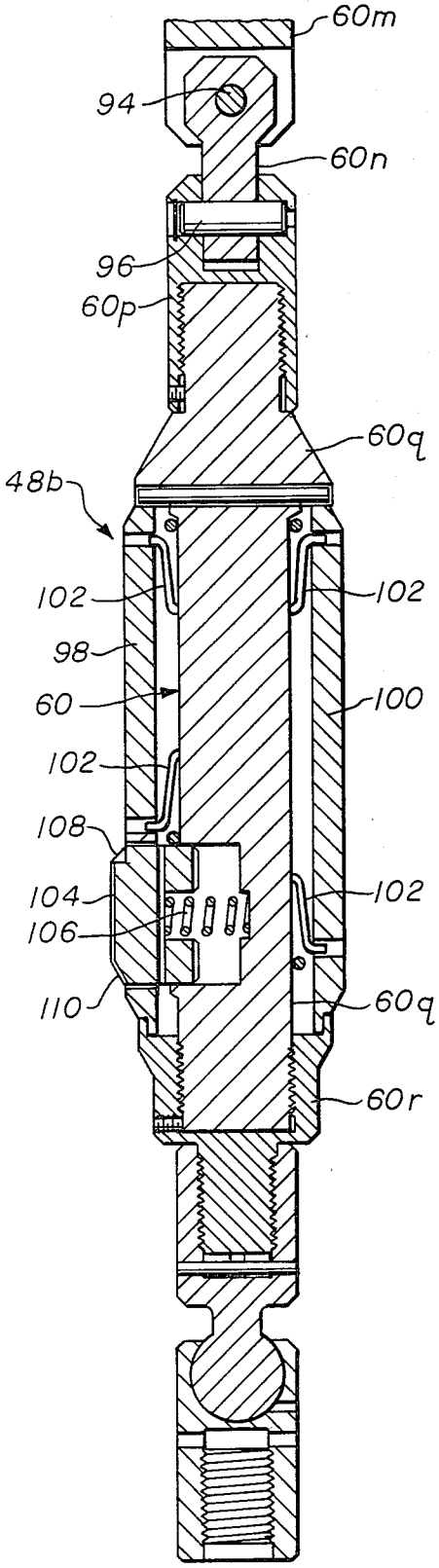
Figure 8:
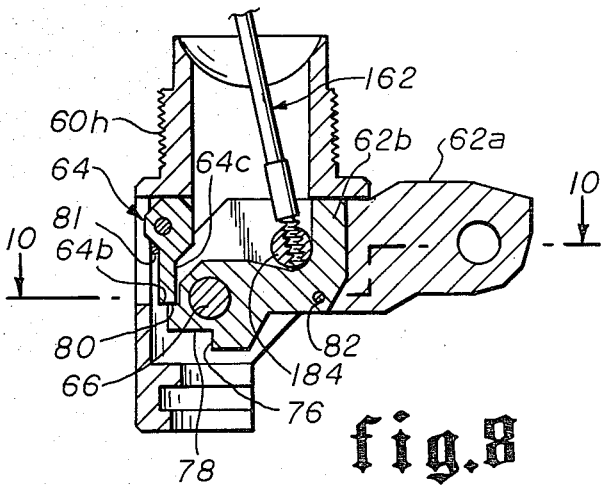
FIG. 8 is a cross-sectional view of the operation section of the well tool of FIGS. 7A through 7D showing the actuated position.
Figure 9:
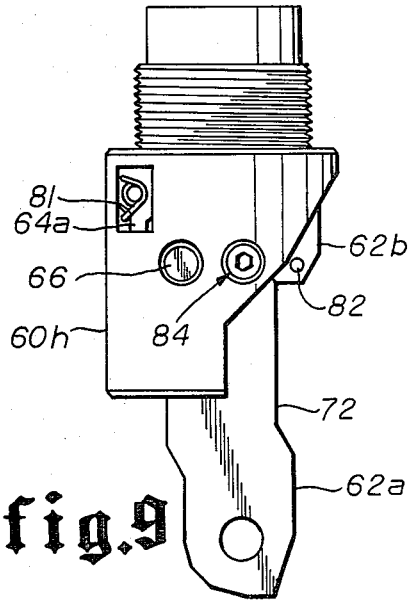
FIG. 9 is an elevational view of the operation section showing the operation section deactivated.

The tool 48 includes elongate body means 60 which forms a portion of and interconnects the operation section 48*a*, the orientation section 48*b* and the actuation section 48*c*. Since the tool 48 is designed for through-the flow-line pump down operations, segments of body means 60 are short enough to pass through the conventional flow line loop 40*a* and are interconnected by articulating joints. Even though articulation between segments is permitted, the rotational orientation between those body segments forming the orientation section 48*b* and at least those body sections forming the operation section 48*a* is maintained. Beginning at the upper portion of the tool as shown in FIGS. 7A, 7B, and 7C, body means 60 comprises a dog mandrel means section 60*a*, an inner cylinder means section 60*b*, a piston means section 60*c*, a stem means and ball means section 60*d*, a socket means section 60*e*, another stem means and ball means section 60*f*, a cap means section 60*g*, an operator housing means section 60*h*, an equipment tray means section 60*i*, an ear means section 60*j*, a clevice means and prong means section 60*k*, a spacer means section 60*m*, another clevice means and prong means section 60*n*, a connector sub means 60*p*, an orientation mandrel means section 60*q*, and an attachment sub means section 60*r*.

The details of the operation section 48*a* of the tool 48 are shown in FIGS. 7B, 8, 9, and 10. The operation section 48*a* performs the desired operation in the well and is movable between a running position (see FIG. 7B) an actuated position (see FIGS. 8 and 10) and a retrieving position (see FIG. 9). In the running and retrieving positions of the operation section 48*a*, movable components of the operation section 48*a* having a longitudinal dimension greater than the width of operator housing means 60*h* are retained within and longitudinally aligned with operator housing means 60*h*. None of the components extend or project radially beyond operator housing means 60*h*. Therefore, when the operation section 48*a* of the tool 48 is in its running or in its retrieving position, the tool 48 may be moved in either of two directions through the tubing string 22 without components of the operation section 48*a* hanging up on obstructions and limiting movement of the tool 48.

The operation section 48*b* of the tool 48 includes arm means 62 carried by the operator housing means 60*h* and latch means 64. The arm means 62 is movable between a running position (see FIG. 7B) and an actuated operating position (see FIGS. 8 and 10). The latch means 64 latches the arm means 62 in its actuated position. During retrieval, a portion 62*a* of the arm means assumes its original position longitudinally aligned with operator housing means 60*h* and another portion 62*b* remains latched in its actuated position. In that retrieving position of arm means 62, neither portion 62*a* and 62*b* projects radially beyond operator housing means 60*h*.

Both portions 62*a* and 62*b* of the arm means 62 are carried by operator housing means 60*h* upon a common pivot means 66 and move with respect to the tool body means 60 thereabout. To set or retrieve equipment 54 in a receptacle 34 of the well, one portion 62*a* of the arm means is a tool carrier means. A running and/or pulling tool 68 is attached to the tool carrier means 62*a*, as with dowel means 70. When arm means 62 is in its actuated, equipment setting or retrieving position, the running and/or pulling tool 68 is preferably aligned with the longitudinal centerline of the side pocket receptacle 34. Additionally, the force application to the running and/or pulling tool 68 during the land and locking of a circulating device 54 in a receptacle 34 and during the pulling of a circulating device 54 from a receptacle 34 is preferably aligned with and along the longitudinal centerline of the receptacle 34. Such tool alignment and force application will more easily land and lock the circulating device 54 in the receptacle 54 and pull the circulating device 54 from the receptacle 34. Additionally, the likelihood of damage to corrosive coatings on the circulating device 54 or mandrel 28 is substantially reduced. To assure that forces are applied substantially aligned with and along the longitudinal centerline of the receptacle 34, the tool carrier means 62*a* portion of arm means 62 has a longitudinal dimension. When the operation section 48*a* is activated, tool carrier means 62*a* extends between housing means section 60*h* and a location wherein the running and/or pulling tool 68 is aligned with the longitudinal centerline of receptacle 34. Additionally, upon actuation of operation section 48*a*, an abutment surface 72 of tool carrier means 62*a* engages a complementary abutment shoulder 74 of operator housing means 60*h*. A force application to the tool body means 60, in a first, downward, direction will therefore be transmitted to the tool carrier means 62*a* and positively imparted to the running and/or pulling tool 68.

The lock means section 62*b* of arm means 62 cooperates with latch means 64 to lock arm means 62 in one of its running and actuated positions. In the running position of arm means 62, latch means 64 and lock means section 62*b* cooperate to substantially eliminate any play and movement of arm means 62. Latch means 64 includes a downwardly depending toggle 64*a*. When are means 62 is in its running position, the tip 64*b* of the toggle 64*a* engages a shoulder 76 of lock means section 62*b*. Pivotal movement of arm means 62 about pivot means 66 in a direction clockwise (as viewed in FIG. 7B) is thus prevented. The side 64*c* of the toggle 64*a* engages a surface 78 of lock means sections 62*b*. Substantial pivotal movement of arm means 62 in a counterclockwise direction (as viewed in FIG. 7B) is resiliently prevented. Once arm means 62 assumes its actuated position, the tip 64*b* of the toggle 64*a* engages a lock shoulder 80 of lock means 62*b*. Thereafter, any rotational movement of arm means 62 is prevented. Arm means 62 is rotationally confined by the engagement between abutment surface 72 and abutment shoulder 74, and between latch means 64 and lock shoulder 80 (see FIG. 8).

A spring 81 resiliently urges the toggle 64*a* of latch means 64 into engagement with lock means 64*b*.

The tool carrier means portion 62*a* and lock means portion 62*b* of arm means 62 are releasably joined together and move in unison upon actuation of the tool 48.

Once the desired operation has been performed, a select force is applied to the tool carrier means portion 62a and the tool carrier means portion 62a and the lock means portion 62b become released from each other. Thereafter, the tool carrier means portion 62a moves independently of lock means 62b and assumes a retrieving position. The lock means portion 62b remains locked in its actuated position. However, the lock means portion 62b does not project radially beyond operator housing means 60h. With tool carrier means 62a in the retrieving position, the tool 48 may be moved in either direction through the tubing string without arm means 62 hanging up on an obstruction in the turing string 22. Shear pin means 82 releasably joins the tool carrier means portion 62a and the lock means portion 62b.

Figure 10:
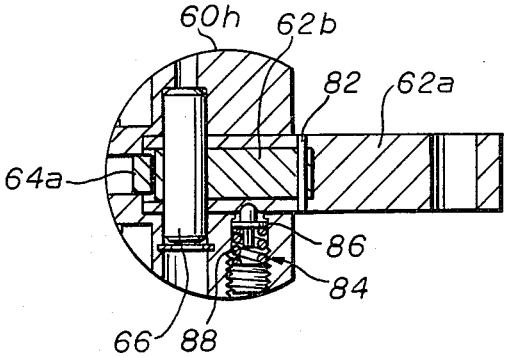
FIG. 10 is a view taken along line 10-10 of FIG. 8.

The tool carrier means is detended in its retrieving position by detent means 84. As illustrated in FIG. 10, a detent button 86 is yieldably urged towards a position engaging the tool carrier means 62a by spring means 88.

Depending from the operator housing means 60h is an equipment tray means 60i. Well equipment, such as the circulating device 54, is carried in a protected position and is received partially within the equipment tray means 60i while the tool 48 is being run in the well.

The orientation section 48b (see FIG. 7C) rotationally orients the operation section 48a with respect to the side pocket receptacle 34 prior to actuation of the operation section 48a. Relative rotation between the operation section 48a and the orientation section 48b is prevented. However, to enable the tool 48 to pass through the conventional pump down loop 40a, articulation of the orientation section 48b with respect to the operation section 48a is permitted. Pin means 90, 92, 94 and 96 interconnect the ear means 60j with the clevice and prong means 60k, the clevice and prong means 60k with the spacer means 60m, the spacer means 60m with the clevice and prong means 60n, and the clevice and prong means 60n with the connector sub means 60p, respectively. Such interconnection of body sections 60j, 60k, 60m, 60n and 60p provides flexture to permit the tool 48 to pass through the loop 40a and maintains rotational alignment between the operation section 48a and the orientation section 48b.

The illustrated orientation section 48b is designed to seek and engage a downwardly facing guide surface 50. To seek that guide surface 50, the orientation section 48b is moved upwardly through the tubing string 22. The orientation section 48b centralizes itself within the tubing string bore 26. As the orientation section 48b enters the orientation sleeve 38, the orientation section 48b becomes centralized prior to engaging the guide surface 50. Once the orientation section 48b becomes centralized within the orientation sleeve 38, the guide surface 50 is engaged. Further upward movement of the orientation section 48b results in the orientation section 48b following the guide surface 50 and rotationally orienting itself within the orientation sleeve 38.

Centralizing key means 98 and 100 are carried by the orientation mandrel means 60q and centralize the orientation section 48b within the tubing string bore 26 and within the orientation sleeve 38. The centralizing key means 98 and 100 are radially movable with respect to orientation mandrel means 60q and are yieldably urged radially outwardly. The yieldable urging is provided by spring means 102. The length of the centralizing key means 98 and 100 is such that the centralizing key means 98 and 100 enter the orientation sleeve 38 and centralize the orientation section 48b therein prior to the time that the guide surface 50 is engaged. Orientation pawl means 104 engages the guide surface 50. Orientation pawl means 104 is radially movable independently of centralizing key means 98 and 100 with respect to orientation mandrel means 60q. When in its outermost position, orientation pawl means 104 projects radially beyond the outermost extremity of centralizing key means 98. To pass through obstructions in the tubing string 22, orientation pawl means 104 is radially retractable. In the radially retracted position of orientation pawl means 104, its radial outermost extremity is flush with the radial outer surface of centralizing key means 98. Coil spring means 106 yieldably urges orientation pawl means 104 radially outwardly with respect to orientation mandrel means 60q. Orientation pawl means 104 includes an upwardly facing surface 108 for engaging the guide surface 50. The upwardly facing surface 108 is chamferred to retract orientation pawl means 104 upon the engagement thereof with an obstruction in the well tubing string 22. Likewise, a downwardly facing chamferred surface 110 of orientation pawl means 104 retracts it upon downward movement of the tool 48 through the tubing string 22.

The actuation section 48c of the tool engages an activating shoulder 36 in the well and transforms a force applied to the tool body means 60 to a force which will actuate the operation tool section 48a. The actuation section 48c is designed to pass through obstructions in the tubing string 22 during movement of the tool 48 in a first, downward direction through the tubing string 22. Upon movement of the tool 48 in a second, upward, direction, the actuation section 48c locates an activating shoulder 36. Once the activating shoulder 36 is located and engaged, a force is applied to the body means 60. The actuation section 48c includes hydraulic means for transforming a high magnitude force applied to body means 60, which force moves body means 60 a relatively short distance, to a low magnitude actuating force which moves a greater distance. The actuating force affects the operation section 48a and actuates it. Thereafter, the actuation section 48c assumes a retrieving position so that it does not engage restrictions in the tubing string 22. If the actuation section 48c should inadvertently engage a restriction, emergency release means render the actuation section 48c unable of resisting movement through such restrictions.

Dog means 112 of actuation tool section 48c locate and engage the activating shoulder 36. Dog means 112 are carried around dog mandrel means 60a by carrier means 114. Carrier means 114 and dog means 112 are longitudinally movable with respect to dog mandrel means 60a between multiple positions. Dog mandrel means 60a includes means for maintaining dog means 112 expanded radially outwardly, such as land means 116 and includes means for permitting inward radial retraction of dog means 112, such as recess means 118 and reduced outside diameter surface 120. Depending upon the relative longitudinal position of carrier means 114 with respect to dog mandrel means 60a, dog means 112 will be opposite one of recess means 118, land means 116 and the reduced outside diameter surface 120. The extent to which dog means 112 projects radially is thus controlled by controlling the longitudinal position of dog means 112 with respect to dog mandrel means 60a.

Shear sub means 122 is releasably connected to carrier means 114. In an emergency, the releasable connection is broken. Once the releasable connection is broken, carrier means 114 readily moves with respect to dog mandrel means 60*a* to a position wherein dog means 112 are opposite one of recess means 118 and reduced outside diameter surface 120. The releasable interconnection between shear sub means 122 and carrier means 114 is provided by emergency shear means 124.

Figure 11:
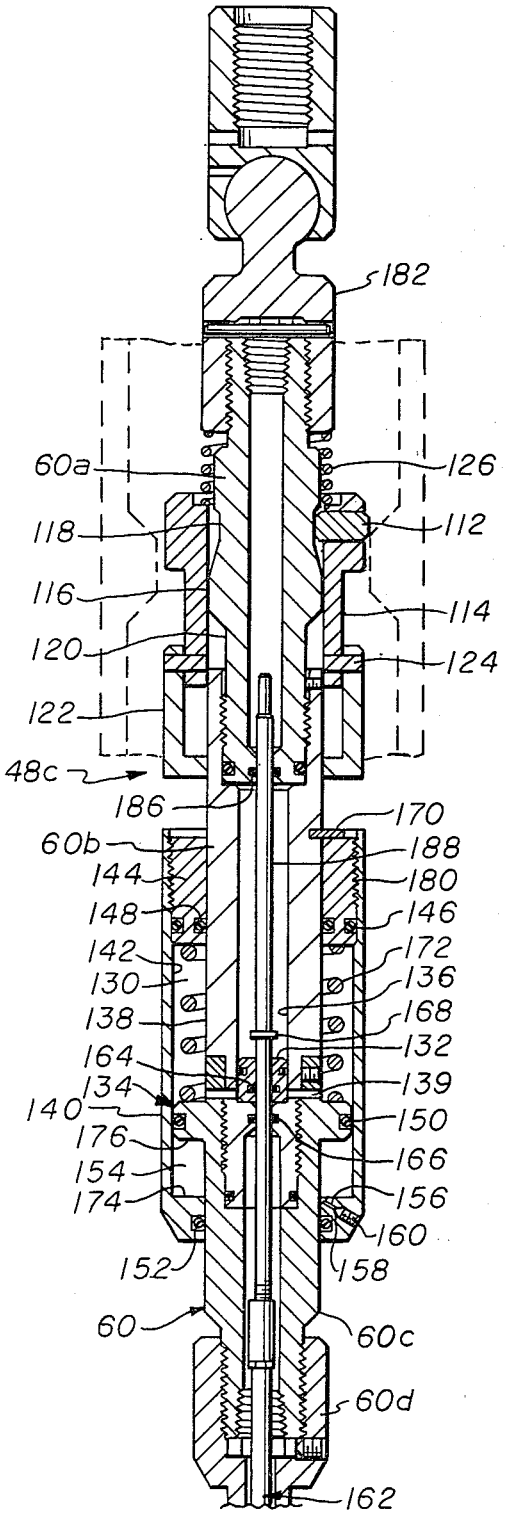
FIGS. 11, 12 and 13 are cross-sectional views showing different positions of the actuation section of the well tool.
Figure 12:
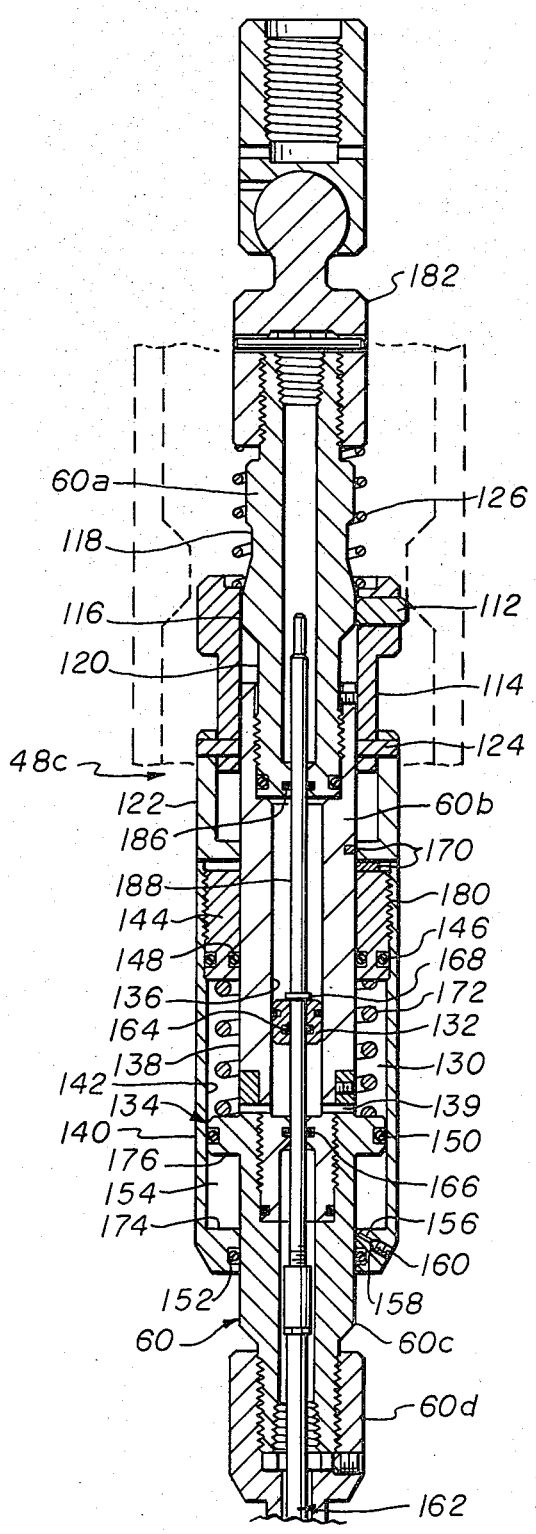
Figure 13:
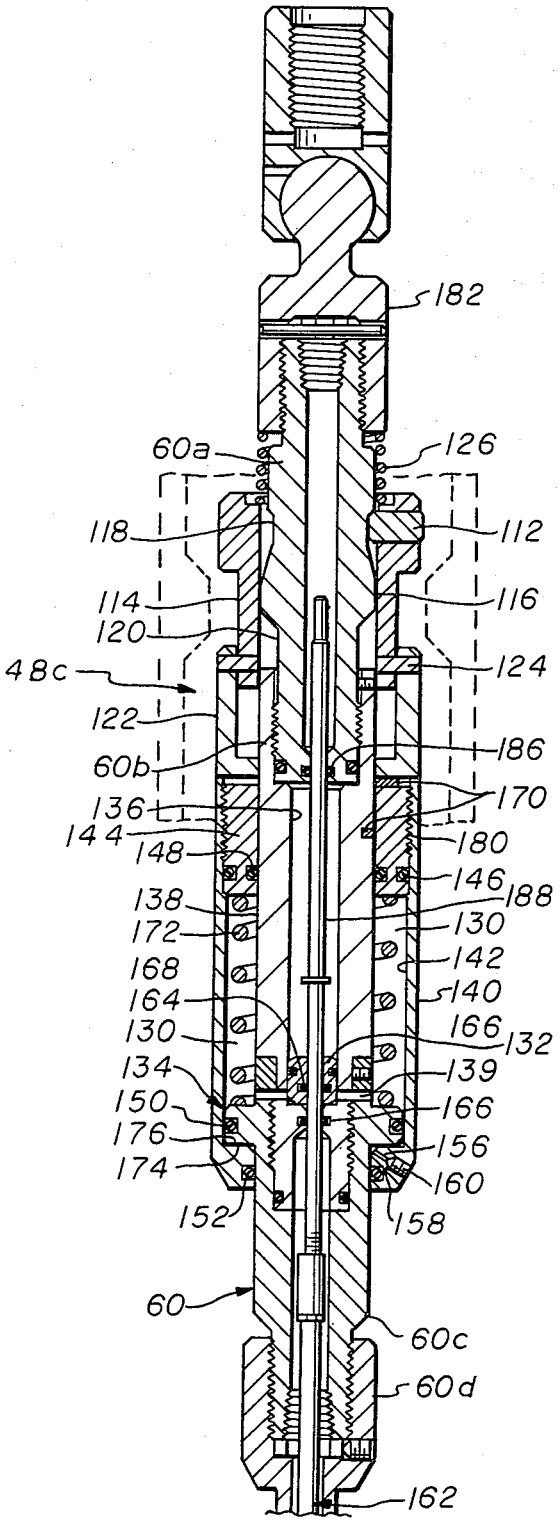

While the tool 48 is being run in the tubing string 22, carrier means 114 is longitudinally movable with respect to dog mandrel means 60*a* between one of its multiple positions wherein dog means 112 is opposite land means 116 (see FIG. 7A) and another of its multiple positions wherein dog means 112 is opposite recess means 118 (see FIG. 11). Carrier means 114 is yieldably urged to said one position by spring means 126. Carrier means 114 moves to said other position against the yieldable urging force of spring means 126.

Once the dog means 112 have engaged the activating shoulder 36, hydraulic means transforms a force applied to body means 60 to an actuating force for operation section 48*a* of the desired magnitude and of the desired distance of travel. The hydraulic means includes two co-communicating hydraulic chambers means 188 and 130, each having a cross-sectional area different from the other and includes two piston means 132 and 134, one for each of the hydraulic chambers means 188 and 130. The hydraulic means is preferably balanced with respect to external fluid pressure.

The inner cylinder means section 60*b* of the tool body means 60 has an enlarged internal longitudinally extending bore 136 for defining a portion of one hydraulic chamber means 188 and has a smooth outside diameter cylindrical surface 138 for defining a portion of the other hydraulic chamber means 130. Port means 139 extend laterally through inner cylinder means 60*b* and communicate between the two hydraulic means 188 and 130.

Sliding piston means 132 is disposed within the longitudinally extending bore 136 of inner cylinder means 130. Sliding piston means 132 and inner cylinder means 60*b* together define one hydraulic chamber means 188. Sliding piston means 132 moves longitudinally within the bore 136 in response to the transfer of hydraulic fluid between the two hydraulic chamber means 188 and 130. Movement of sliding piston means 132 in a first direction with respect to inner cylinder means 60*b* imparts an actuating force to the operation tool section 162*b*.

Cylinder means 140 surrounds inner cylinder means section 60*b* and defines a portion of the other hydraulic chamber means 130 with its internal wall 142. Cylinder nut means 144 is associated with cylinder means 140. Seal means 146 seals between cylinder nut means 144 and cylinder means 140 and seal means 148 seals between cylinder nut means 144 and inner cylinder means section 60*b* to further define the other hydraulic chamber means 130. Seal means 150 is carried by piston means section 60*c* and seals between piston means section 60*c* and cylinder means 140 to further define hydraulic chamber means 130. Together seal means 150 and piston means section 60*c* form piston means 134. Relative movement between cylinder means 140 and the actuator body sections 60*b* and 60*c* will vary the volume of hydraulic chamber means 130.

Preferably external fluid pressure, such as the pressure due to well fluids surrounding actuation section 48*c*, does not cause movement of cylinder means 140 with respect to actuator body sections 60*b* and 60*c*. Cylinder means 140 is therefore, preferably, fluid pressure balanced with respect to body means 60. Cylinder means 140 carries seal means 152 for sealing between cylinder means 140 and piston means section 60*c*. The seal affective area of seal means 152 is substantially equal to the seal effective area of seal means 148. Thus, the net longitudinal pressure force applied to cylinder means 140 by external fluid is substantially zero. Vacuum chamber means 154 is formed between cylinder means 140 and piston means section 60*c* by seal means 150 and 152. Vacuum chamber means 154 prevents relative movement between cylinder means 140 and actuator body sections 60*b* and 60*c* from being inhibited due to a shock absorber affect. Port means 156 extends through cylinder means 140 and opens in vacuum chamber means 154. Gasket means 158 and set screw means 160 are positioned in port means 156 and permit the formation of the vacuum chamber means 154 during the assembly of the actuation section 48*c*.

Actuator means 162 extend between sliding piston means 132 and the operation tool section 48*a*. Movement of sliding piston means 132 in a first direction with respect to inner cylinder means 60*b* results in a substantially corresponding movement of actuator means 162. Actuation of the operation tool section 48*a* occurs upon the movement of arm means 62 from its first, running position to its second, tool setting or retrieving position. Such movement of arm means 62 will occur upon the application of a moment arm to arm means 62 which tends to pivot arm means 62 about pivot means 66. Actuator means 162 may therefore, be any member capable of withstanding a tensile load for applying such a moment arm to arm means 62. At least a portion of actuator means 162 may be flexible. Such flexible portion 162*a* preferably extends through the interconnected body sections 60*d*, 60*e* and 60*f*. These body sections 60*d*, 60*e* and 60*f* form flexible swivel connecting means and interconnect the operation tool section 48*a* and the actuation tool section 48*c*. To facilitate handling during assembly, at least a portion 162*b* of actuator means 162 is a substantially rigid longitudinal rod 162*b*. The actuator rod portion 162*b* extends through sliding piston means 132. Seal means 164 is carried by sliding piston means 132 and seals between sliding piston means 132 and actuator rod 162*b*. To render the actuator means 162 pressure balanced to external fluid pressure, seal means 166 is carried by body section 60*b* and seals between body section 60*b* and actuator rod 162*b*. The seal effective area of seal means 186 and 166 are equal and would subject actuator rod 162*b* to equal and opposite external fluid pressure forces. Actuator rod 162*b* includes lug means 168. Sliding piston means 132 engages lug means 168 when it moves in a first direction. Movement of sliding piston means 132 in a first direction thus imparts a substantially corresponding movement to actuator means 162.

Shear pin means 170 releasably holds cylinder means 140 in a first position with respect to body means to (see FIGS. 7A and 11). As long as cylinder means 140 remains in its first position, no hydraulic fluid is transferred between the two hydraulic chambers 188 and 130. Consequently, sliding piston means 132 remains in its first position and does not impart a force tending to move actuator means 162. Shear pin means 170 is sheared to permit relative movement between cylinder means 140 and body means 60. For at least a portion of that relative movement, the volume of the two hydraulic chamber means 188 and 130 changes inversely (e.g., the amount of increase for one volume equals the amount of decrease for the other volume). To actuate the operation tool section 48*a*, cylinder means 140 assumes a second position with respect to body means 60 (see FIG. 12). During the relative movement between the first position of cylinder means 140 with respect to body means 60 (see FIG. 7A) and the second position of cylinder means 140 with respect to body means 60 (see FIG. 12), the volume of the two hydraulic chamber means 128 and 130 does change inversely and the transfer of hydraulic fluid between the two hydraulic chamber means 188 and 130 moves sliding piston means in a first direction with respect to body means 60. Preferably, the cross-sectional areas of the two hydraulic chamber means are such that there is approximately a one to ten (1:10) ratio between the relative movement of cylinder means 140 with respect to body means 60 and the relative movement of sliding piston means 132 with respect to body means 60. That relative movement of sliding piston means 132 in a first direction, moves actuator 162. Actuator means 162 in turn applies an actuating force to the operation tool section 48*a*. Cylinder means 140 is also movable with respect to body means 60 to a third position (see FIG. 13). For the illustrated actuation tool section 48*c*, relative movement of cylinder means 140 between its first position and its second position occurs in one direction and relative movement of cylinder means 140 between its second position and its third position occurs in another direction. During movement of cylinder means 140 between its second position and its third position, cylinder means 140 passes through its first position. Although prior to the shearing of shear pin means 170, dog means 112 is movable longitudinally with respect to body means 60 independently of cylinder means 140, once shear pin means 170 shears, dog means 112 and cylinder means 140 move longitudinally with respect to body means 60 in unison. Dog means 112 remains disposed around land means 116 during the unitary longitudinal movement of dog means 112 and cylinder means 140 between the first and second position of cylinder means 140. Once cylinder means 140 assumes its third position, dog means 112 are disposed opposite recess means 118. Spring means 172 yieldably urges cylinder means 140 towards its third position. The yieldable force applied by spring means 172 acts in a direction opposite to the direction of the resilient urging force of spring means 126. Spring means 172 is more powerful than spring means 126. Therefore, once shear pin means 170 has been sheared, spring means 172 overpowers spring means 126 and moves both of cylinder means 140 and carrier means 114 upwardly relative to body means 60. Movement of cylinder means 140 upwardly relative to body means 60 is limited and is stopped by the engagement of cylinder stop shoulder 174 with piston means section stop surface 176 (see FIG. 13).

The preferred sequence of assembly for the tool actuation section 48*c* assures that the two hydraulic chamber means 188 and 130 are charged with a select amount of imcompressible fluid without any trapped compressible gasses and that trapped gases do not remain within vacuum chamber means 154. All seal means may be first positioned on their respective carrying members. Sliding piston means 132 is inserted into the longitudinal bore 136 of inner cylinder means section 60*b*. Sliding piston means 132 is pushed through the bore 136 until it bottoms out. Inner cylinder means section 60*b* is interconnected with piston means section 60*c*. Interconnected body sections 60*b* and 60*c* are inserted into cylinder means 140 until shoulders 174 and 176 abut. Gasket means 158 is positioned in port means 156. Set screw means 160 is threaded into port means 156, and, together with gasket means 158 seals off port means 156. Inserting piston means 60*c* into cylinder means 140 until shoulders 174 and 176 abut has evacuated substantially all of the air out of vacuum chamber means 154. Gasket means 158 thereafter prevents air from reentering vacuum chamber means 154 during relative movement between cylinder means 140 and the body sections 60*b* and 60*c*. Actuator rod means 162*b* is inserted through sliding piston means 132 until it extends through seal means 164. However, care is taken so that actuator rod means 162*b* does not extend through seal means 166. Spring means 172 is positioned within the annular chamber 130 between inner cylinder means section 60*b* and cylinder means 140. The assembly is turned upright. Hydraulic fluid is positioned within the annular chamber 130 until it reaches a level substantially equal to the bottom of the threads 180. Cylinder nut means 144 is slid over the upstanding inner cylinder means section 60*b* and is engaged with threads 180. The assembly is turned upside down and cylinder nut means 144 is made up with cylinder means 140. As cylinder nut means 144 advances within threads 180, hydraulic fluid is forced out of the defined hydraulic chamber means 188 and 130 past seal means 166. As the hydraulic fluid is forced out, air is evacuated from the system. Once the nut 144 has been made up, cylinder means 140 is moved to its first position and shear pin means 170 is installed. Thereafter, actuator rod means 162*b* is slid through seal means 166. The hydraulic chamber means 188 and 130 are thereby locked. Within the hydraulic chamber means 188 and 130 is disposed a specific amount of hydraulic fluid which transfers between the two chambers 188 and 130 depending upon the relative position of cylinder means 140 and the body sections 60*b* and 60*c*. To complete the assembly of the actuation section 48*a*, shear sub means 122 is connected to carrier means 114 by shear means 124. Dog means 112 are positioned within carrier means 114. Dog mandrel means 60*a* is interconnected with inner cylinder means 60*b*. The joined shear sub means 122 and carrier means 114 are slid over the dog mandrel means 60*a*. Spring means 126 is positioned around dog mandrel means 60*a* on the top of carrier means 114. Thereafter, a connector 182 is attached to dog mandrel means 60*a*. The connector 182 holds spring means 126 in place and interconnects the tool 48 with other tools in a well tool train.

The actuator means 162 is operably associated with the lock means portion 62*b* of the arm means 62. Therefore, the tool carrier means portion 62*a* of the arm means 62 may assume its retrieving position regardless of the force applied by actuator means 162 to the lock means portion 62*b*. Dowl means 184 interconnects actuator means 162 and the lock means portion 62*b*. Dowl means 184 is offset from pivot means 66. Therefore, movement of actuator means 158 in a first direction, imparts a moment arm to the lock means portion 62*b* of arm means 62 about pivot means 66. When tool carrier means 62*a* is joined to lock means 62*b*, the imparted moment arm pivots arm means 62 to its actuated, equipment setting and/or retrieving position.

In operation, the tool 48 is utilized to set or retrieve equipment in a well. To install equipment 54 in the well, an appropriate running tool 68 would be attached to arm means 62. The equipment 54 would be positioned in the tool tray means 60*i* and the operation section 48*a* arranged so that arm means 60 was in its running position. The tool 48 is interconnected into a tool train. The tool train is run through the well. Prior to entering the well, the tool train and the tool 48 could pass through the conventional flow line loop 40*a*.

The tool train would be moved through the tubing string 22 in a first, downward direction, past the operating region. During that movement of the tool train projecting components of the tool 48 would retract upon engagement with obstructions in the tubing string 22. For example, engagement of the chamferred surface 110 of orientation pawl means 104 with an obstruction cams orientation key means 104 radially inwardly. The centralizing key means 98 and 100 of the orientation section 48*b* can likewise be cammed radially inwardly. The designed effective diameter of the orientation section 48*b*, when its centralizing key means 100 and orientation pawl means 104 are radially retracted, enables the section 48*b* to pass through obstructions in the tubing string 22. When dog means 112 of the actuation section 48*c* strike an obstruction, dog means 112 and carrier means 114 remain longitudinally stationary. Body means 60 continues its downward movement. After a slight (approximately three fourths of an inch) movement of body means 60, dog means 112 become disposed opposite recess means 118. The dog means 112 retract (see FIG. 11). The retraction of dog means 112 enables the actuation section 48*c* to pass through the obstruction. Once actuation section 48*c* has passed through the obstruction, spring means 126 returns carrier means 114 to its first position. The dog means 112 become backed up by land means 116 and are maintained in their expanded position until another obstruction is encountered. In such a manner, the tool 48 is run to any desired position in the tubing string 22.

The tool 48 is run through the side pocket mandrel 28 in which it will be operated. Dog means 112 will therefore engage the activating shoulder 36 and the orientating section 48*b* will coact with the guide surface 50 upon movement of the tool in a second direction. The tool 48 is run in a second, upward, direction for orientation and actuation in the mandrel 28. The rotational orientation of the operating section 48*a* relative to the side pocket mandrel 28 is fixed prior to actuation thereof. The orientation section 48*b* enters the orientation sleeve 38. Centralizing key means 98 and 100 engage the internal wall of the orientation sleeve 38 and centralize the orientation section 48*b* therein. Due to the length of the centralizing key means 98 and 100 above the orientation key means 104, the orientation section 48*b* is centralized prior to the time that the orientation key means 104 engages the guide surface 50. Centralization of the orientation section 48*b* within the orientation sleeve 38 increases the likelihood that the orientation key means 104 will locate the guide surface 50. Upon slight further movement of the tool 48 in said second direction, orientation key means 104 locates and engages the guide surface 50. Movement of the tool 48 continues. Orientation key means 104 follows the guide surface 50 and rotationally orients the operation section 48*a* within the mandrel 28. When the orientation key means 104 enters the guide slot 52 the operation section 48*a* is oriented. Arm means 62 is facing the receptacle and will be aligned therewith upon actuation. Thereafter, continued upward movement of tool body means 60 will actuate the operation section 48*a*. Dog means 112 engage the activating shoulder 36. Movement of dog means 112 is arrested. Likewise, until the operation tool section 48*a* is actuated, further movement of the cylinder means 140 with respect to the tubing string 22 is prevented. A continued upward application of force to body means 60 actuates the operation section 48*a*. For example, approximately 650 psi differential pressure could be applied to the locomotive means 46. For a three-inch tubing, that would translate to a 4,550 pound force applied upwardly to body means 60. Shear pin means 170 shears. Body means 60 moves upwardly with respect to cylinder means 140 approximately two-tenths of an inch (0.2″). During that upward movement of body means 60, dog means 112 remain disposed around land means 116. Although dog means 112 and cylinder means 140 remain stationary in the tubing string 22, movement of body means 60 results in dog means 112 and cylinder means 140 assuming their second, operative position with respect to body means 60. During the movement of body means 60, the volume of the hydraulic chamber means 188 and 130 changes inversely. The transfer of hydraulic fluid between the two hydraulic chamber means 188 and 130 positively moves sliding piston means 132 in a first direction. Sliding piston means 132 engages lug means 168 of actuator means 162 and moves actuator means 162 approximately two inches (2″) (see FIG. 12).

The longitudinal force applied by piston means 132 to actuator means 162 and transmitted by actuator means 162 to the operation tool section 48*a* imparts a moment arm to arm means 62 about pivot means 66. The moment arm pivots arm means 62 about pivot means 66 from its running position to its actuated position. Arm means 62 is latched in its actuated position by the engagement of the end 64*b* of the latch toggle 64*a* with the shoulder 80 of lock means 62*b*. Regardless of the deviation and orientation of the mandrel 28, the circulating device 54 and the running tool 68 are aligned with the longitudinal centerline of the receptacle 34. The tool 48 is run back in a first, downward, direction to set, land and lock the well equipment 54 in the side pocket receptacle 34. During the setting operation, abutment surface 72 of arm means 62 engages abutment shoulder 74 of the tool operator housing section 60*h*. Due to that abutment, a downward force applied to body means 60 will be positively transmitted to the running tool 68.

As the tool 48 moves downwardly, the actuator section 48*c* assumes a retrieving position wherein dog means 112 are freely retractable. Dog means 112 become spaced from the activating shoulder 36. Since shear pin means 170 is sheared, spring means 172 is rendered effective. Spring 172 is more powerful than spring 126. Spring means 172 moves cylinder means 140 and carrier means 114 to a third position with respect to dog mandrel section 60*a*. Movement of cylinder means 140 is stopped by the abutment of shoulder means 174 and 176. Dog means 112 are disposed around recess means 118, and will retract therein whenever they engage an obstruction in the tubing string 22.

Once the well equipment 54 has been set in the receptacle 34, another upward force is applied to the tool 48. The running tool 68 releases from the landed and locked well equipment 54. The tool 48 begins movement in a second, upward direction through the tubing string 22. The projecting tool carrier means portion 62*a* of arm means 62 engages the downwardly facing belly 32*a* of the side pocket offset 32 (see FIG. 6). An upward application of force to body means 60 shears pin means 82. The tool carrier means 62*a* is moved to its retrieving position. Detent means 84 engages and locks tool carrier means 62*a* in its retrieving position. The tool 48 can now be retrieved through the tubing string 22.

During retrieval, the tool 48 may be moved in either direction through the tubing string 22. No component of the operation section 48*a* projects radially beyond housing means 60*h*. Tool carrier means 62*a* is locked in a retrieving position wherein it does not project radially beyond housing means 60*h* and wherein it is longitudinally aligned with housing means 60*h*. It thus presents no obstruction to movement through the tubing string 22. Components of the orientation section 48*b* constrict radially whenever an obstruction is encountered in the manner previously described. The actuation section 48*c* will not restrict tool movement either. Dog means 112 are yieldably maintained around recess means 118 by spring means 172. Retraction of dog means 112 into recess means 118 should enable passage of the actuation section 48*c* through obstruction in the tubing string. However, if dog means 112 should hang up on an obstruction, emergency shear means 124 is sheared. Thereafter, carrier means 114 can move relative to dog mandrel means 60*a* to a fourth position wherein dog means 112 are disposed around reduced outside diameter surface 120. Dog means 112 can then radially retract onto surface 120. When so retracted, the radial outermost extremity of dog means 112 will be radially within the radial outermost extremity of carrier means 114. Thus, tool 48 will travel through the tubing string 22 without hanging up therein.

In lieu of using pump down locomotive means 46 as the transport and force applying means for the tool 48, the tool 48 may form a portion of a wire line tool train. Under such circumstances, the hydrostatic head of fluid within the tubing string 22 may affect movement of sliding piston means 132. To reduce the effect of the hydrostatic fluid pressure, seal means 186 seals between actuator rod means 162*a* and body means section 60*a*. The seal effective area of seal means 186 and of seal means 166 is preferably substantially equal. Thus, actuator means 162 would be fluid pressure balanced. The chamber 188 between seal means 186 and sliding piston means 132 would be filled with air at atmospheric pressure during assembly of the actuation tool section 48*c*. Since air is compressable, relative movement between cylinder means 140 and body means 60 will still cause sliding piston means 132 to move in a first direction and apply a force to actuator means 162. The operation of the tool 48 in a wire line tool train would be similar to its operation in a pump down tool train.

From the foregoing, it can be seen that the objects of this invention have been obtained. An improved tool for setting and retrieving well equipment has been provided.

The orientation section of the tool includes centralizers. The centralizers and the guide surface seeking orientation key function independently. As the orientation key does not have to perform the additional function of centralizing the orientation section, it is more likely to locate and engage the guide surface.

The operation section of the tool has three positions, a running position, an actuated position and a retrieving position. A two-piece arm is initially joined and is moved in unison from the running position to the actuated position. The actuated position is the equipment setting and/or retrieving position of the operation section. One piece of the arm projects radially when actuated and carries a running and/or pulling tool. The other piece of the arm is engaged by a latch so that the arm is locked in its actuated position. Once the desired operation has been performed, said one piece is freed from said other locked piece and is moved to a retrieving position. In its retrieving position, said one piece does not project radially beyond the operator housing and is longitudinally aligned with other components of the operation section. Additionally that one piece is detented in its retrieving position.

The actuation section includes dogs movable longitudinally along the tool body for affecting control of actuation of the operation section. While the tool is being run into the well in a first direction, the dogs are resiliently urged to a first expanded position and are releasably prevented from assuming a second expanded and tool actuating position. The dogs may be moved against the resilient urging force to a third retractible position to permit the tool to pass through a restriction. The dogs affect actuation of the operation section upon movement of the tool in a second direction. Upon such movement the dogs engage an activating shoulder in the well. The dogs are released for relative movement with the tool body to their second expanded and tool actuating position. During such relative movement, a confined change of hydraulic fluid transfers between two chambers formed in the actuation section. The fluid transfer produces an actuating force for the operation tool section. The actuating force is transmitted to the operation section by an elongate actuator. Thereafter, once the dogs become spaced from the activating shoulder, the dogs are yieldably urged to their third retractable position. In an emergency, the dogs may assume a fourth retracted position.

The foregoing disclosure and description of this invention are illustrative and explanatory thereof. Various changes in the size, shape and materials, as well as the details of the illustrated construction may be made within the scope of the appended claims without departing from the spirit of the invention.

What is claimed is:

1. A tool for setting or retrieving well equipment in a well comprising:

elongate body means;

arm means carried by said body means and movable between a first, running position and a second position for setting or retrieving equipment;

means for moving said arm means from said first position to said second position and including:

means extending beyond the exterior of said body for engaging an activating shoulder in the well upon movement of said body means in one direction, and hydraulic means, operable upon continued movement of said body means in said one direction once said engaging means has engaged an activating shoulder, for applying a force for actuating movement of said arm means from said first to said second position.

2. The tool of claim 1 additionally including:

orientation means comprising:

centralizer means including at least a pair of centralizing key means resiliently carried by said body means for centralizing said orientation means in a well pipe;

orientation pawl means adapted to move radially with respect to said body means independently of said centralizer means between a first position projecting beyond said centralizing means and a second position retracted within said centralizing means and for engaging an orientation guide surface in a well pipe; and means for yieldably urging said orientation pawl means to its first position, said centralizer means operative to centralize said orientation means prior to said orientation pawl means engaging said orientation guide surface.

3. The tool of claim 1 wherein: said arm means includes:

tool carrier means, lock means, and means for initially joining said tool carrier means and said lock means so that said tool carrier means and said lock means move in unison from said first position to said second position and for permitting said tool carrier means to move independently of said lock means to a retrieving position; and additionally including latch means for engaging said lock means and for latching said lock means in said second position.

4. The tool of claim 3 additionally including:

detent means for detenting said tool carrier means in said retrieving position.

5. A tool for operating within a well pipe at a select orientation with respect to the well pipe comprising:

operation means for performing a desired operation in a well pipe;

orientation means for locating an orientation guide surface in a well pipe and including:

elongate body means, centralizer means including at least a pair of centralizing key means radially movable with respect to said body means for centralizing said orientation means in a well pipe, means for yieldably urging said centralizing key means radially outwardly, orientation pawl means movable radially with respect to said body means independently of said centralizer means between a first position projecting beyond said centralizing means for locating and engaging an orientation guide surface upon movement of said tool through said well pipe in a first direction and a second position retracted within said centralizing means;

means for yieldably urging said orientation pawl means to said first position; and means for interconnecting said orientation means and said operation means and for maintaining the relative rotational orientation between said operation means and said orientation means, said centralizing means centralizing said orientation means prior to said orientation pawl means engaging said orientation guide surface when said tool is moved in said first direction.

6. The operating tool of claim 5 wherein said operation means includes:

housing means;

arm means carried by said housing means and movable between a running position and a second position for setting and/or retrieving equipment;

a first portion of said arm means comprising tool carrier means;

a second portion of said arm means comprising lock means;

means for initially joining said tool carrier means and said lock means so that said tool carrier means and said lock means move in unison from said first position to said second position and for permitting said tool carrier means to move independently of said lock means to a retrieving position; and latch means for engaging said lock means and for locking said lock means in said second position.

7. The operating tool of claim 6 additionally including:

detent means for detenting said tool carrier means in said retrieving position.

8. A tool for performing a desired operation in a well pipe and comprising:

operation means movable between a running position and an actuated position for performing the desired operation;

actuator means for actuating said operator means and including:

elongate body means, cylinder means carried by said body means, said cylinder means and said body means defining two co-communicating variable volume closed hydraulic chamber means;

means carried by said body means for engaging an activating shoulder in the well and having multiple positions with respect to said body means;

a charge of fluid in said co-communicating variable volume hydraulic chamber means;

force applying means for being affected by said charge of fluid and extending between said actuator means and said operation means and for transmitting an actuating force to said operation means;

said engaging means being adapted to engage an activating shoulder upon movement of said body means in one direction through a well pipe and, while engaged with said activating shoulder, moving between a first and a second of said multiple positions upon continued movement of said body means in said one direction;

wherein upon movement of said engaging means between said first and second positions the volume of said two hydraulic chamber means varies inversely and at least a portion of said change of fluid transfers between said two hydraulic chamber means and affects said force applying means to cause an actuating force to be transmitted to said operating means.

9. The tool of claim 8 wherein:

said engaging means has a third position;

and additionally including:

means for resiliently urging said engaging means towards said first position as said tool is being run in the well, means for permitting said engaging means to pass through restrictions when in said third position; and means for releasably preventing said engaging means from assuming said second position until a select force is applied to said body means.

10. The tool of claim 8 additionally including:

orientation means for locating an orientation guide surface in a well pipe and including:

elongate body means, centralizer means including opposed centralizing key means radially movable with respect to said body means for centralizing said orientation means in a well pipe, means for yieldably urging said centralizing key means radially outwardly, orientation pawl means movable radially with respect to said body means independently of said centralizer means between a first position projecting beyond said centralizing means for locating and engaging an orientation guide surface upon movement of said tool through said well pipe in a first direction and a second position retracted within said centralizing means;

means for yieldably urging said orientation pawl means to said first position; and means for interconnecting said orientation means and said operation means and for maintaining the relative rotational orientation between said operation means and said orientation means.

11. The tool of claim 8 wherein said operation means includes:

housing means;

arm means carried by said housing means and movable between a running position and a second position for setting and/or retrieving equipment;

a first portion of said arm means comprising tool carrier means;

a second portion of said arm means comprising lock means;

means for initially joining said tool carrier means and said lock means so that said tool carrier means and said lock means move in unison from said first position to said second position and for permitting said tool carrier means to move independently of said lock means to a retrieving position; and latch means for engaging said lock means and for locking said lock means in said second position.

12. The tool of claim 11 additionally including:

detent means for detenting said tool carrier means in said retrieving position.

13. An actuating tool comprising:

operation means movable between a running position and an actuated position for performing the desired operation;

actuator means for actuating said operator means and including:

elongate body means;

cylinder means carried by said body means;

said body means and said cylinder means forming two co-communicating variable volume closed hydraulic chamber means;

said cylinder means having multiple positions with respect to said body means;

means for releasably maintaining said cylinder means in a first of said multiple positions;

a change of fluid within said two hydraulic chamber means;

force applying means for being affected by said change of fluid and extending between the actuation means and the operation means and for transmitting an actuating force to the operation means when said cylinder means moves with respect to said body means between said first position and a second position of said multiple positions causing at least a portion of said charge of fluid to transfer between said two hydraulic chamber means;

means carried by said body means for engaging an activating shoulder in the well and having multiple positions with respect to said body means and for controlling said relative movement of said cylinder means between said first and second positions.

14. For use in combination with the actuator tool of claim 13, an operation tool comprising:

housing means;

means for interconnecting said elongate body means and said housing means;

arm means carried by said housing means and movable between a running position and a second position for setting and/or retrieving equipment;

a first portion of said arm means comprising tool carrier means;

a second portion of said arm means comprising lock means;

means for initially joining said tool carrier means and said lock means so that said tool carrier means and said lock means move in unison from said first position to said second position and for permitting said tool carrier means to move independently of said lock means to a retrieving position;

means for interconnecting said lock means and said force applying means; and latch means for engaging said lock means and for locking said lock means in said second position.

15. The combination of claim 14 additionally including:

detent means for detenting said tool carrier means in said retrieving position.

16. The combination of claim 14 additionally including:

orientation means for locating an orientation guide surface in a well pipe and including:

elongate body means, centralizer means including at least two centralizing key means radially movable with respect to said body means for centralizing said orientation means in a well pipe, means resiliently urging said centralizing key means radially outwardly, orientation pawl means movable radially with respect to said body means independently of said centralizer means between a first position projecting beyond said centralizing means for locating and engaging an orientation guide surface upon movement of said tool through said well pipe in a first direction and a second position retracted within said centralizing means;

means for yieldably urging said orientation pawl means to said first position; and means for interconnecting said orientation means and said operation tool and for maintaining the relative rotational orientation between said operation tool and said orientation means.

17. An operation tool for setting and/or retrieving equipment in a well and comprising:

housing means;

arm means carried by said housing means and movable between a running position and a second position for setting and/or retrieving equipment;

a first portion of said arm means comprising tool carrier means;

a second portion of said arm means comprising lock means;

means for initially joining said tool carrier means and said lock means so that said tool carrier means and said lock means move in unison from said first position to said second position and for permitting said tool carrier means to move independently of said lock means to a retrieving position; and latch means for engaging said lock means and for locking said lock means in said second position.

* * * * *